United States Patent [19]

Hinzmann

[11] 4,249,547

[45] Feb. 10, 1981

[54] METHOD AND APPARATUS FOR APPLYING ADHESIVE TO RUNNING WEBS OF WRAPPING MATERIAL

[75] Inventor: Alfred Hinzmann, Richmond, Va.

[73] Assignee: Hauni-Werke Körber & Co. KG., Hamburg, Fed. Rep. of Germany

[21] Appl. No.: 79,828

[22] Filed: Sep. 28, 1979

Related U.S. Application Data

[63] Continuation-in-part of Ser. No. 56,798, Jul. 11, 1979.

[51] Int. Cl.[3] ..... A24C 5/52

[52] U.S. Cl. ..... 131/94; 131/90; 131/69; 131/11; 118/212; 101/170

[58] Field of Search ..... 131/60, 67, 69, 34, 131/35, 37, 58, 90, 70 R, 94; 118/212; 101/170; 156/291; 428/214

[56] References Cited

U.S. PATENT DOCUMENTS

| | | | |
|---|---|---|---|
| 1,817,435 | 8/1931 | Freuder | 101/170 |
| 2,169,638 | 8/1939 | Gilfillan | 118/212 X |
| 3,470,884 | 10/1969 | McArthur | 131/94 |

*Primary Examiner*—Stephen C. Pellegrino
*Attorney, Agent, or Firm*—Peter K. Kontler

[57] ABSTRACT

One side of a running web of wrapping material which is to be converted into discrete uniting bands in a filter tipping machine is provided with one or more patterns of adhesive strips by a roller which dips into a supply of adhesive and directly or indirectly transfers adhesive to one side of the running web. The roller has peripheral grooves including grooves of greater depth and grooves of lesser depth so that the adhesive which forms the pattern includes thicker and thinner fields. The thicker fields have discrete strips which are adjacent to but spaced apart from the marginal portions of the web. When the web is subdivided into uniting bands, each edge of each uniting band is adjacent to adhesive and the strips of the thicker field adhere to the wrappers of plain cigarettes. Portions of thinner fields extend in the axial direction of a filter cigarette of unit length or double unit length.

23 Claims, 4 Drawing Figures

Fig. 3
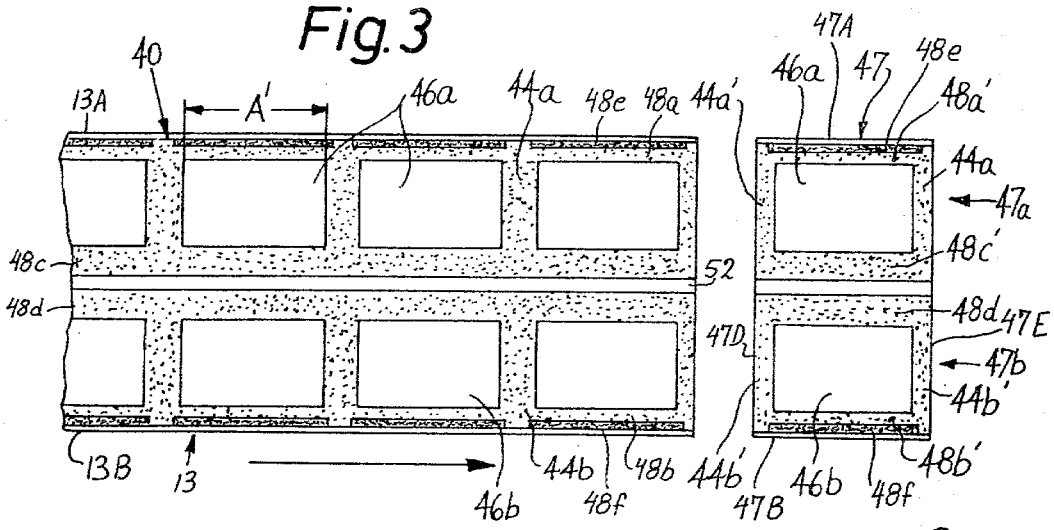
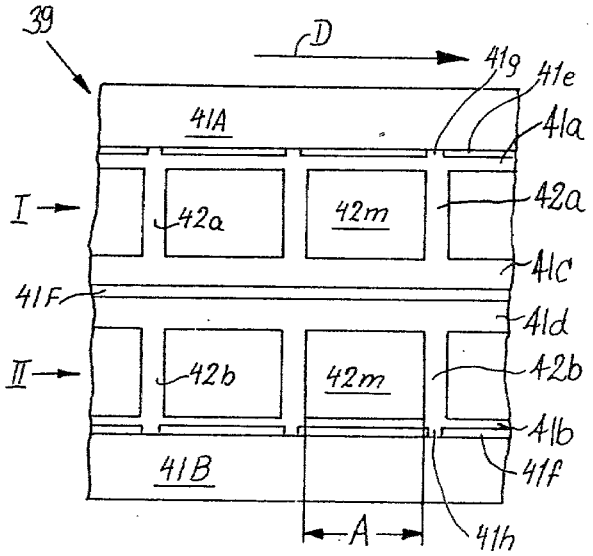
Fig. 2
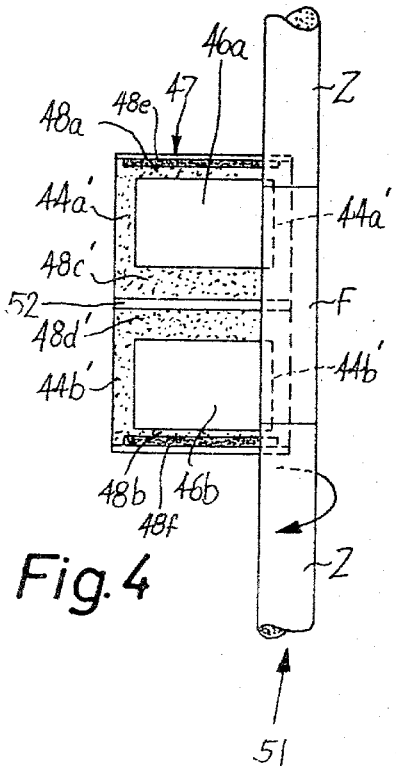
Fig. 4

METHOD AND APPARATUS FOR APPLYING ADHESIVE TO RUNNING WEBS OF WRAPPING MATERIAL

CROSS-REFERENCE TO RELATED APPLICATION

This is a continuation-in-part of my copending application Ser. No. 56,798 filed July 11, 1979 for "Method and apparatus for applying adhesive to running webs of wrapping material."

BACKGROUND OF THE INVENTION

The present invention relates to a method and apparatus for treating webs of wrapping material for rod-shaped articles which constitute or form part of smokers' products. More particularly, the invention relates to a method and apparatus for applying adhesive to running webs of such wrapping material. Still more particularly, the invention relates to improvements in a method and apparatus for applying adhesive paste to running webs of cigarette paper, artificial cork or other suitable wrapping material prior to subdivision of such webs into discrete uniting bands. The uniting bands can be used to connect filter plugs of unit length or multiple unit length with one or more tobacco-containing rod-shaped articles, e.g., with plain cigarettes, cigars or cigarillos.

It is already known to apply adhesive to a moving web of wrapping material in such a way that, when the web is subdivided into discrete uniting bands of square or rectangular outline, all four edges of each uniting band are adjacent to strips of adhesive which has been applied to one side of the web. This is achieved by resorting to a paster wherein a rotary element draws adhesive from a tank and has peripheral grooves distributed in such a way that the grooves form a pattern corresponding to the desired pattern of adhesive strips at one side of the moving web. The leader of the web is severed at regular intervals by one or more cutters to yield a succession of uniting bands which are attached to successive groups of coaxial rod-shaped articles. The groups are thereupon rolled about their respective axes during travel through a gap whose width is less than the diameter of a group whereby the uniting bands are converted into tubes which sealingly connect the articles of the respective groups to each other. Such procedure is normally resorted to in the manufacture of filter cigarettes, cigars or cigarillos.

It has become customary to provide the wrappers of filter plugs of filter cigarettes or like rod-shaped smokers' products with one or more holes or perforations which admit atmospheric air into the column of hot tobacco smoke. The admission of atmospheric air is believed to be beneficial as regards the quantity of nicotine and/or condensates in the smoke which enters the smoker's mouth. Instead of using filter plugs with perforated wrappers, it is also possible and customary to resort to wrappers having a relatively high porosity so that one or more streamlets of cool atmospheric air can enter the tobacco smoke via pores rather than through artificially formed perforations of the wrapper for the filter plug.

Utilization of uniting bands which are provided with adhesive strips along their edges but not on the central portion of the adhesive-coated side is desirable and necessary in order to insure that the adhesive cannot clog the pores and/or artificially produced perforations, i.e., to insure the admission of predictable quantities of cool atmospheric air into the tobacco smoke. The aforementioned grooves in the periphery of the rotary adhesive-applying element of the paster insure that the central portion of a uniting band remains free of adhesive. The depth of all grooves is the same, i.e., the thickness of the strips which are applied to one side of the moving web and thereupon surround a centrally located uncoated area of each uniting band is the same. It is also known to drive the rotary element at a peripheral speed which exceeds or is less than the speed of lengthwise movement of the web in the region of the paster. This results in spreading of adhesive which forms the strips and in more uniform distribution of adhesive at one side of the web.

Problems arise in connection with the sealing of joints between the filter plugs and the plain cigarettes. More particularly, it can happen that the joints between the wrappers of two plain cigarettes and the two end portions of a tube which is obtained upon conversion of a uniting band as a result of rolling of a group consisting of two plain cigarettes and a filter plug of double unit length therebetween will produce leaks in regions where the end portions of the converted uniting band adhere to the wrappers of plain cigarettes. This results in admission of undesirable quantities of additional atmospheric air and is annoying to the smoker because the quantity of smoke which enters the mouth is less than anticipated. As a rule, the extent to which a converted uniting band (tube) surrounds the inner end portions of wrappers of plain cigarettes of unit length is in the range of a few millimeters. On the other hand, it is highly desirable that such regions be absolutely airtight, i.e., that atmospheric air be allowed to enter solely through the pores or perforations of a converted uniting band, namely, through pores or perforations in that portion of the converted uniting band which is not coated with adhesive. The establishment of pockets or clearances between the end portions of the converted (tubular) uniting band and the surrounded portions of wrappers of plain cigarettes which are connected to filter plugs is a problem which the manufacturers of filter cigarettes attempted to solve by applying thick strips of adhesive, i.e., by applying to the moving web adhesive in such quantities as to insure the establishment of a reliable circumferentially complete seal between each end portion of a converted uniting band and the adjacent portions of wrappers of plain cigarettes in a filter cigarette of double unit length.

The thickness of adhesive strips on the moving web of cigarette paper or the like cannot be increased at will for several reasons. First of all, the aforementioned spreading of adhesive as a result of slippage between the web and the rotary element of the paster is not predictable if the thickness of one or more adhesive strips is excessive. Secondly, the surplus of adhesive is likely to leak beyond the end portions of the converted uniting band and to contaminate the external surfaces of filter cigarettes. Still further, the surplus of adhesive causes the filter cigarettes to adhere to conveyors or other parts during further transport through a filter tipping machine. Also, the surplus of adhesive is likely to adhere to knives or cutters which are used to subdivide the moving web into discrete uniting bands and/or the knife or knives which are used to sever each filter cigarette of double unit length midway between its ends so that each such cigarette yields two coaxial filter cigarettes of unit length in a manner which is customary in presently known filter tipping machines. Finally, the surplus of adhesive can contaminate the surfaces flanking the aforementioned gap wherein the groups of coaxial rod-shaped articles are rolled to convert the uniting bands into tubes. Contamination of rolling means and/or knives entails lengthy interruptions of operation with attendant substantial losses to output, especially in a modern machine which turns out many thousands of smokers' products per minute.

Attempts to reduce the likelihood of contamination of filter tipping and analogous machines with adhesive paste include the application of relatively thick layers of adhesive only to those portions of uniting bands which adhere to the wrappers of plain cigarettes, cigars or cigarillos. This is satisfactory insofar as the prevention of development of pockets or the like is concerned; however, when the uniting bands are rolled to convert them into tubes which connect plain cigarettes or the like with filter plugs, the surplus of adhesive invariably emerges from within the convoluted uniting band and contaminates the wrapper(s) of the tobacco containing article(s). Therefore, the appearance of the final products is less than satisfactory and the squeezed out surplus of adhesive rapidly contaminates those components of the machine which roll the uniting bands as well as the parts which thereupon transport and/or otherwise manipulate the filter tipped products.

OBJECTS AND SUMMARY OF THE INVENTION

An object of the invention is to provide a novel and improved method of coating one side of a moving or running web of wrapping material with adhesive in such a way that the uniting bands which are obtained as a result of repeated severing of the leader of the adhesive-coated web properly adhere to rod-shaped articles which constitute and/or form part of smokers' products but the adhesive cannot contaminate any component parts of the machine, not even those parts which convert uniting bands into tubes surrounding filter plugs and portions of plain cigarettes or the like.

Another object of the invention is to provide a method of the just outlined character which can be resorted to with particular advantage in the manufacture of filter tipped smokers' products and insures economical use of adhesive and predictable admission of atmospheric air into the column of tobacco smoke when the smokers' product is lighted.

A further object of the invention is to provide a method which can be practiced by resorting to relatively simple apparatus and which can be utilized in connection with the manufacture of large- or small-diameter smokers' products as well as in connection with the making of filter tipped smokers ' products having short, medium long or long filter plugs.

An additional object of the invention is to provide a novel and improved apparatus for the practice of the above outlined method and to provide the apparatus with novel and improved means for applying recurrent patterns of adhesive to a moving web of wrapping material, such as cigarette paper, artificial cork or the like.

Another object of the invention is to provide the apparatus with a novel and improved paster which can be used in filter tipping or like machines as a superior (especially more economical) substitute for heretofore known pasters.

One feature of the invention resides in the provision of a method of treating a web of wrapping material in a machine (e.g., in a filter tipping machine) for the processing of rod-shaped smokers' products. The method comprises the steps of transporting the web lengthwise along a predetermined path (e.g., by means of two driven advancing rolls which draw the web from a roll or from another suitable source of supply), and coating one side of the moving or running web with a suitable adhesive (e.g., a hot melt or a wet adhesive). The coating step includes applying to the one side of the moving web a recurrent pattern of adhesive which comprises first fields or patches including discrete longitudinal strips of adhesive adjacent to but slightly spaced apart from at least one marginal portion of the moving web and having a first thickness, and second fields or patches (preferably including transverse strips extending transversely of the one side between the longitudinal strips and having portions disposed between the longitudinal strips) having a second thickness which is less than the first thickness. The method further comprises repeatedly severing the leader of the moving web across successive transverse strips and their portions so that the web yields a series of discrete uniting bands each having two first parallel edges one of which is adjacent to the respective longitudinal strip and two second parallel edges adjacent to the end portions of the respective longitudinal strip (and also adjacent to the severed and normally halved portions of the corresponding transverse strips).

The first thickness exceeds the second thickness because the uniting bands are preferably attached to groups of coaxial rod-shaped articles in such a way that the first edges extend transversely of and the second edges extend in parallelism with the common axis of the respective group.

The coating step may further include applying to the one side of the moving web additional strips of adhesive inwardly adjacent to the longitudinal strips and having a thickness which at least approximates the second thickness.

Still further, the coating step may comprise applying to the one side of the moving web discrete longitudinal strips adjacent to the other marginal portion of the web so that each longitudinal strip at the one first edge is aligned with a longitudinal strip at the other of the first edges and each of the first edges of a uniting band is adjacent to a discrete longitudinal strip upon severing of such uniting band from the moving web. The just discussed embodiment of the method is preferred when the uniting bands are used to connect pairs of coaxial rod-shaped articles to a third rod-shaped article therebetween, e.g., to connect pairs of plain cigarettes of unit length with a filter plug of double unit length in a manner known from the manufacture of filter cigarettes.

The coating step of the just discussed embodiment of the method may further include applying to the one side a pair of further strips which are disposed substantially midway between the marginal portions of the web and intersect the transverse strips. Each of the transverse strips can be applied in the form of two aligned sections one of which extends between one of the further strips and the nearer marginal portion of the moving web and the other of which extends between the other further strip and the marginal portion nearer to such other further strip. This method can be practiced with advantage in connection with the manufacture of filter cigarettes, cigars or cigarillos of double unit length. In order to convert such smokers' products into filter cigarettes, cigars or cigarillos of unit length, the uniting bands are draped or convoluted around the filter plugs and around the adjacent inner portions of plain cigarettes, cigars or cigarillos, and the resulting product is halved by cutting it across the convoluted uniting band between the aforementioned further strips of adhesive. The thickness of the further strips preferably matches or approximates the second thickness, i.e., the thickness of the aforementioned transverse and/or additional strips. The transverse additional and further strips form part of the second patches or fields.

The feature that the first fields or patches including the longitudinal strips are slightly spaced apart from the respective marginal portion or portions of the moving web is especially desirable when the longitudinal strips form rings about the respective groups of articles. The adhesive which forms the longitudinal strips will be caused to flow in response to draping of the respective uniting bands, and the provision of some space between the longitudinal strips and the respective edges of a uniting band insures that the adhesive will not spread beyond the outline of the convoluted uniting band.

The manner in which the uniting bands are attached to groups of rod-shaped articles and in which the thus attached uniting bands are convoluted around the respective groups of articles is preferably the same or similar to the mode of manipulating uniting bands in the MAX S filter tripping machine of the assignee. Thus, successive groups of coaxial rod-shaped articles are transported sideways along a second path and successive uniting bands are applied to successive groups so that the uniting bands adhere to and are disposed substantially tangentially of the respective groups. The groups are thereupon rolled about the common axis of their rod-shaped constituents during travel between the surfaces whereby the uniting bands are converted into tubes which connect the articles of the respective groups to each other.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a fragmentary developed view of the periphery of a roller-shaped component of the coating device in the improved apparatus, the width and length of the grooves in the periphery of the roller corresponding substantially to their actual dimensions;

FIG. 3 shows a portion of the web with the pattern of adhesive applied thereto, a freshly separated uniting band being shown adjacent to the leader of the web at or close to actual size; and FIG. 4 is an elevational view of a group of three coaxial rod-shaped articles with a uniting band partially attached thereto, the diameters of the articles corresponding to or approximating those of the components of a filter cigarette of double unit length.

DESCRIPTION OF THE PREFERRED EMBODIMENTS

Figure 1:
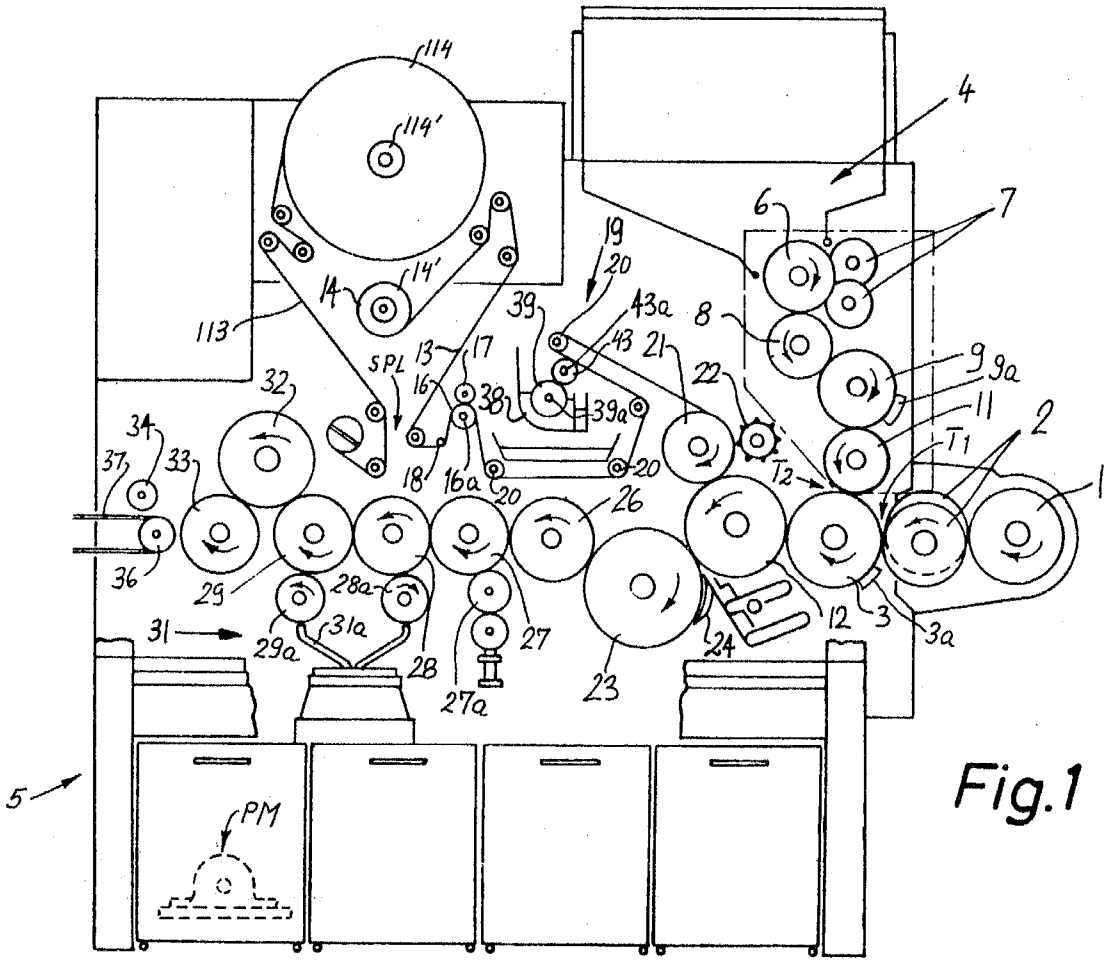
FIG. 1 is a schematic elevational view of a filter tipping machine which embodies the improved apparatus.

FIG. 1 shows a filter cigarette making or filter tipping machine of the type known as MAX S (produced by the assignee of the present application). The machine is directly coupled to a maker of plain cigarettes of unit length, e.g., to a machine known as GARANT (trademark) produced by the assignee of the present application. The maker comprises a rotary drum-shaped row forming conveyor 1 which is mounted in or on the frame 5 of the filter tipping machine and has peripheral flutes for continuous delivery of two rows of plain cigarettes or unit length. The flutes of the conveyor 1 are parallel to its axis, i.e., the cigarettes are transported sideways. The cigarettes of one row are admitted into the oddly numbered flutes and the cigarettes of the other row are admitted into the evenly numbered flutes of the conveyor 1. Furthermore, the cigarettes of one row are adjacent to one axial end and the cigarettes of the other row are adjacent to the other axial end of the conveyor 1.

The filter tipping machine comprises a pair of rotary drum-shaped aligning conveyors 2 which are mounted in the frame 5 adjacent to the row forming conveyor 1 and have peripheral flutes for sidewise transport of plain cigarettes toward a transfer station T1. One of the conveyors 2 receives successive plain cigarettes of one row, and the other conveyor 2 receives successive plain cigarettes of the other row. The conveyors 2 are driven at different speeds and/or transport the plain cigarettes of the respective rows through different distances so that each flute or a rotary drum-shaped assembly conveyor 3 which arrives at the transfer station T1 receives a pair of coaxial plain cigarettes of unit length. The plain cigarettes of each pair are separated from each other by a gap having a width which at least equals the length of a filter rod section of filter plug of double unit length.

The upper portion of the frame 5 supports a magazine 4 for filter rod sections of six times unit length. The outlet of the magazine 4 receives a portion of a rotary drum-shaped severing conveyor 6 having peripheral flutes which remove filter rod sections from the magazine 4 and transport them past two rotary disk-shaped knives 7 which are staggered with respect to each other, as considered in the axial and circumferential direction of the conveyor 6. The latter cooperates with the knives 7 to subdivide each filter rod section of six times unit length into sets of three coaxial filter rod sections or plugs of double unit length. The filter plugs of each set are transferred into peripheral flutes of three rotary drum-shaped staggering conveyors 8 (only one shown) which rotate at different speeds and/or transport the respective filter plugs through different distances to thereby stagger the plugs in the circumferential direction of the illustrated conveyor 8. The staggering conveyors 8 deliver discrete filter plugs of double unit length into successive flutes of a rotary drum-shaped shuffling conveyor 9 which cooperates with two stationary cams **9*a* to convert the filter plugs into a single row wherein each preceding plug is in exact register with the next-following plug. Successive plugs of the thus obtained row are delivered into successive flutes of a rotary drum-shaped accelerating conveyor 11 which deposits such plugs into successive flutes of the assembly conveyor 3 at a second transfer station T2 preceding the station T1**. Each inserted filter plug of double unit length is positioned in such a way that it is flanked by two coaxial plain cigarettes of unit length after the respective flute of the conveyor 3 advances beyond the station T1. The thus obtained groups 51 (FIG. 4) of three coaxial rod-shaped articles each (a filter plug of double unit length and two plain cigarettes of unit length) are thereupon caused to move through the gap between two stationary condensing cams 3*a* which move the inner ends of the plain cigarettes into contact with the respective ends of the coaxial filter plug. The condensed groups 51 are delivered into the flutes of a rotary drum-shaped transfer conveyor 12.

The frame 5 of the filter cigarette making machine further supports a spindle 14' for a roll 14 of convoluted wrapping material which constitutes an elongated web 13 consisting of cigarette paper, artificial cork or the like. The web 13 is drawn off the roll 14 by a transporting unit including two advancing rolls 16 and 17 at least one of which is driven by the prime mover PM of the filter tipping machine and the other which is preferably biased against the one roll. Successive increments of the web 13 are caused to pass along the relatively sharp edge of a curling device 18 of the type disclosed in commonly owned U.S. Pat. No. 3,962,957 granted June 15, 1976 to Alfred Hinzmann. The purpose of the curling device 18 is to eliminate and/or equalize internal stresses in the material of the web 13. One side of the moving or running web 13 is coated with a suitable adhesive by the rotary applicator roller 43 of a coating device or paster 19 which is installed in the frame 5 downstream of the advancing rolls 16 and 17. The leader of the web 13 adheres to the periphery of a rotary attaching device here shown as a suction drum 21 which cooperates with a rotary severing tool or knife 22 to subdivide the web 13 into a succession of discrete polygonal adhesive-coated uniting bands 47 (see FIGS. 3 and 4). Such bands are attached to successive groups 51 of rod-shaped articles on the transfer conveyor 12, preferably in such a way that each band 47 extends tangentially of the respective group and adheres to the respective filter plug F as well as to the inner end portions of the respective plain cigarettes Z (see FIG. 4).

A second spindle 114' supports a roll 114 consisting of convoluted wrapping material which constitute an elongated web 113. The leader of the web 113 is located at a splicing station SPL which includes means for attaching the leader of the web 113 to the running web 13 when the diameter of the roll 14 is reduced to a predetermined minimum value. The device at the splicing station SPL may be of the type disclosed in commonly owned U.S. Pat. No. 3,586,006 granted June 22, 1971 to Gerd-Joachim Wendt.

Successive groups 51 in the flutes of the transfer conveyor 12 (each such group carries a discrete uniting band 47) are delivered to a rotary drum-shaped wrapping conveyor 23 which cooperates with a stationary or mobile rolling device 24 to roll successive groups 51 around their common axis and to thus convert the respective uniting bands 47 into tubes which sealingly surround the filter plugs F and the inner ends of plain cigarettes Z of the respective groups, i.e., each group 51 is converted into a filter cigarette of double unit length. The wrapping conveyor 23 delivers successive filter cigarettes of double unit length into the flutes of a rotary drum-shaped heating or drying conveyor 26 which insures that the adhesive on each tube sets prior to transfer into the flutes of a rotary drum-shaped severing conveyor 27 cooperating with a rotary disk-shaped knife 27A which severs each filter cigarette of double unit length midway across the tube so that such cigarettes yield pairs of coaxial filter cigarettes of unit length (hereinafter called cigarettes for short). Defective cigarettes (e.g., those without a filter plug or tobacco-containing portion) are ejected during travel along the periphery of the severing conveyor 27.

The conveyor 27 delivers pairs of cigarettes to the rotary drum-shaped conveyor 28 of a turn-around device 31 of the type disclosed in commonly owned U.S. Pat. No. 3,583,546 granted June 8, 1971 to Gerhard Koop. One cigarette of each pair is transferred onto a second conveyor 28*a* and is inverted through 180 degrees by one of several orbiting arms 31*a*. The other cigarettes of successive pairs are transferred into alternate flutes of a third rotary drum-shaped conveyor 29 of the device 31. A fourth conveyor 29*a* of the device 31 delivers inverted cigarettes into empty flutes of the conveyor 29 so that the inverted cigarettes are disposed between neighboring non-inverted cigarettes and the cigarettes form a single row wherein the filter mouthpieces of all cigarettes face in the same direction.

The conveyor 29 delivers successive cigarettes of the single row to a rotary drum-shaped conveyor 32 forming part of a testing apparatus wherein the cigarettes are monitored to ascertain whether or not their wrappers are satisfactory. Cigarettes having defective wrappers are segregated from satisfactory cigarettes during travel with a rotary drum-shaped conveyor 33 which is located downstream of the conveyor 32 and delivers satisfactory cigarettes onto the upper reach of a belt conveyor 37 trained over pulleys 36 (one shown). The illustrated pulley 36 cooperates with a rotary braking drum 34. The conveyor 37 delivers satisfactory cigarettes into storage, into chargers, to a pneumatic sender or directly into the magazine of a packing machine, not shown.

The conveyor 33 may be associated with a device which monitors the tobacco-containing ends of successive cigarettes and generates signals for ejection of cigarettes having unsatisfactory tobacco-containing ends. Such ejection can take place at the station for ejection of cigarettes having defective wrappers.

The prime mover PM transmits motion to all or nearly all rotary and/or otherwise movable components of the machine. The drive for the suction drum 21 is preferably designed in such a way that the peripheral speed of the drum 21 exceeds the speed of lengthwise movement of the web 13 along the path which is defined by the advancing rolls 16, 17 and several guide rolls 20. This insures that each freshly formed uniting band 47 becomes automatically separated from the leader of the remaining portion of the web 13 (see FIG. 3) prior to attachment of such uniting band to an oncoming group 51 on the transfer conveyor 12. In other words, the peripheral surface of the drum 21 slips with respect to the leader of the web 13 and, therefore, it immediately separates a freshly formed uniting band 47 as soon as a cutter of the rotary severing tool 22 has completed the making of a cut across the web.

The paster 19 comprises a vessel or tank 38 for a supply of adhesive paste and a roller 39 whose peripheral surface dips into the supply of paste and removes adhesive for transfer of such adhesive onto the peripheral surface of a roller-shaped applicator 43. The latter, in turn, applies a recurrent pattern of adhesive patches or fields to one side of the moving web 13. The pattern is shown in FIGS. 3 and 4, and the configuration of the periphery of the roller 39 is illustrated in FIG. 2. The periphery of the roller 39 has two sets or rows I and II of recesses in the form of grooves extending in part circumferentially and in part in parallelism with the axis of the roller 39. The sets I and II are mirrors symmetrical to each other with reference to a plane which is normal to the axis of the roller 39 and is disposed substantially midway between the axial ends of this roller. The direction of rotation of the roller 39 is indicated by the arrow D.

The grooves in the periphery of the roller 39 include discrete relatively deep and relatively narrow longitudinal grooves 41*e*, 41*f* which extend in the circumferential direction of the roller 39. These grooves can be said to form part (deeper portions) of additional longitudinal grooves 41*a*, 41*b* which also extend in the circumferential direction of the roller 39. Furthermore, the periphery of the roller 39 is formed with equidistant transverse grooves each of which includes two aligned sections or portions 42*a*, 42*b*. Each groove 41*e* is aligned with a groove 41*f*, as considered in the axial direction of the roller 39, and the transverse grooves 42*a*, 42*b* extend in parallelism with the axis of the roller 39 between consecutive pairs of aligned grooves 41*e*, 41*f*. The depth of the grooves 41*a*, 41*b* is preferably the same as or closely approximates the depth of the grooves 42*a*, 42*b*.

The periphery of the roller 39 is also formed with two further grooves 41*c*, 41*d* which extend substantially midway between the two files of deeper grooves 41*e*, 41*f* and intersect the transverse grooves 42*a*, 42*b*. The narrow rib or land 41F between the grooves 41*c*, 41*d* insures that the adhesive which is confined in the groove 41*c* cannot flow into the groove 41*d* or vice versa. The sections 42*a* of transverse grooves 42*a*, 42*b* extend from the groove 41*c* to the groove 41*a*, and the sections 42*b* extend from the groove 41*d* to the groove 41*b*. The reference characters 41*g* and 41*h* denote the outermost parts of sections 42*a*, 42*b* between the neighboring longitudinal grooves 41*e*, 41*f*. The depth of the parts 41*g* and 41*h* is preferably the same as that of the groove 41*a*, 41*b*, 41*c*, 41*d* and 42*a*, 42*b*. The reference characters 41*m* denote raised panels at the periphery of the roller 39, i.e., those portions of the periphery from which no material has been removed and whose exposed surfaces are at the level of the land 41F, as considered in the radial direction of the roller 39.

The various grooves in the periphery of the roller 39 can be formed by utilizing a grinding tool or by resorting to another suitable technique. The surfaces of the panels 41*m* and of the land 41F (as well as the surfaces of rings 41A, 41B which are outwardly adjacent to the files of longitudinal grooves 41*e*, 41*f*) are highly polished to insure full contact with the peripheral surface of the roller 43. The latter surface is also finished with a high degree of precision to insure that it will receive a pattern of adhesive from the various grooves of the roller 39. The smooth cylindrical peripheral surface of the roller 43 receives such adhesive which is confined in the grooves 41*a*, 41*b*, 41*c*, 41*d*, 41*e*, 41*f*, parts 41*g*, 41*h*, and grooves 42*a*, 42*b*. Since the grooves 41*e*, 41*f* are deeper than the other grooves and parts 41*g*, 41*h*, the thickness of those strips of the adhesive pattern on the peripheral surface of the roller 43 which are formed by adhesive leaving the grooves 41*e*, 41*f* will exceed the thickness of the other adhesive coats. The pattern which is formed on the peripheral surface of the roller 43 is thereupon transferred onto the adjacent side of the moving web 13.

Referring again to FIG. 1, the shaft 16*a* drives the advancing roll 16 at a peripheral speed which is different from and preferably exceeds the peripheral speed of the rollers 39 and 43 (these rollers are respectively driven by shafts 39*a* and 43*a*). Consequently, the web 13 slips relative to the peripheral surface of the roller 43 with the result that the pattern 40 of adhesive strips which is transferred from the roller 43 onto one side of the moving web is somewhat blurred. This is indicated in FIGS. 2 and 3; it will be noted that the length A of a panel 42*m* (as considered in the circumferential direction of the roller 39) is less than the length A' of the complementary uncoated portion 46*a* or 46*b* of the one side of the web 13. The peripheral speed of the roller 39 matches that of the roller 43. The difference between the peripheral speed of the roller 43 and the speed of lengthwise movement of the web 13 entails a stretching or lengthening of the pattern 40 of adhesive strips, as considered in the longitudinal direction of the moving web 13. More specifically, the transverse strips 44*a*, 44*b* of the pattern 40 (such strips are formed as a result of transfer of adhesive from the corresponding grooves 42*a*, 42*b* onto the peripheral surface of the roller 43 and thence onto the one side of the web 13 and such strips constitute portions of fields or patches of adhesive which further include adhesive transferred or removed from the outermost parts 41*g*, 41*h* of the transverse grooves 42*a*, 42*b*) are wider than the grooves 42*a*, 42*b*, as considered in the longitudinal direction of the web 13, and the length A' of uncoated portions 46*a*, 46*b* exceeds the length A of raised panels 42*m*.

The pattern 40 further includes a thicker field or patch composed of relatively narrow longitudinal strips 48*e*, 48*f* which are closely adjacent to but somewhat spaced apart from the respective marginal portions 13A, 13B of the moving web 13, additional strips 48*a*, 48*b* which are inwardly adjacent to the respective files of strips 48*e*, 48*f*, and further strips 48*c*, 48*d* which are disposed substantially midway between the strips 48*a*, 48*b* and are separated from each other by a relatively narrow uncoated portion 52. The pattern 40 has two halves which are mirror symmetrical to each other with reference to a plane extending lengthwise of the web 13 and halving the uncoated portion 52. The thickness of adhesive which forms the field including the strips 44*a*, 44*b*, 48*a*, 48*b*, 48*c*, 48*d* is less than the thickness of adhesive which forms the field including the strips 48*e*, 48*f*. This is due to the fact that the depth of the longitudinal grooves 41*e*, 41*f* exceeds the depth of grooves 41*a*, 41*b*, 41*c*, 41*d*, 42*a*, 42*b* and portions 41*g*, 41*h*.

Successive square or rectangular uniting bands 47 are obtained by severing the leader of the web 13 midway across successive transverse strips 44*a*, 44*b*. One side of each uniting band 47 carries a pattern of the type shown in the right-hand portion of FIG. 3. Such pattern consists of a first field including two relatively narrow but relatively thick longitudinal strips 48*e*, 48*f* which are respectively adjacent to but slightly spaced apart from the corresponding (first) parallel edges 47A, 47B of the uniting band 47, and a second field including portions 44*a*', 44*b*' of corresponding transverse strips 44*a*, 44*b* which are respectively adjacent to the other pair of parallel edges 47D, 47E of the uniting band 47, two additional strips 48*a*', 48*b*' which constitute portions of the strips 48*a*, 48*b*, and two further strips 48*c*', 48*d*' which constitute portions of strips 48*c*, 48*d*.

When a uniting band 47 is attached to the oncoming group 51 of three coaxial aligned rod-shaped articles Z, F, Z, the longitudinal strips 48*e*, 48*f* extend transversely of the common axis of such group 51, and the transverse strips 44*a'*, 44*b'* extend in parallelism with the axis of such group (see FIG. 4). The attachment is effected by the suction drum 21 whose peripheral surface has suction ports connected to a suitable suction chamber in the interior of the drum 21 in a manner known from the art of filter tipping machines. The uniting band 47 adheres to the group 51 because one of its transverse strips (including the aligned sections 44*a'*, 44*b'*) is applied to the cylindrical wrapper of the filter plug F as well as to the innermost portions of the cylindrical wrappers of the two plain cigarettes Z. When the respective group 51 thereupon reaches the wrapping conveyor 23 and moves past the rolling device 24, such group is caused to rotate about its own axis and the uniting band 47 is converted into a tube which bonds the article F (filter plug of double unit length) to the two aligned articles Z (plain cigarettes of unit length). This is due to the fact that the width of the gap between the periphery of the conveyor 23 and the adjacent concave surface of the rolling device 24 is slightly less than the diameter of a group 51.

The group 51 which advances beyond the gap between the conveyor 23 and rolling device 24 constitutes a filter cigarette of double unit length which is transferred onto the severing conveyor 27 and is halved by the disk-shaped knife 27*a* so that it yields two filter cigarettes of unit length. The knife 27*a* severs the tubular wrapper (convoluted uniting band 47) midway across the uncoated portion 52 between the strips 48*c'*, 48*c'*. This insures that the cutting edge of the knife 27*a* is not contaminated by adhesive and can be used, without maintenance, for extended periods of time. Moreover, and since the relatively thick longitudinal strips 48*e*, 48*f* of the unconvoluted uniting band 47 are slightly spaced apart from the respective edges 47A, 47B, spreading of adhesive which forms these longitudinal strips does not result in leakage of adhesive beyond the edges 47A, 47B. This is advisable for several reasons. For example, dried adhesive outside of the edges 47A, 47B could affect the appearance of the filter cigarettes. Moreover, such adhesive could prevent controlled transfer of filter cigarettes from conveyor to conveyor, especially from the conveyor 23.

The uniting band 47 which is shown in FIGS. 3 and 4 carries an adhesive pattern which consists of two mirror symmetrical halves 47*a*, 47*b*. If the uniting bands are used to attach a single plain cigarette Z to a filter plug of unit length (i.e., to one-half of a filter plug F), the configuration of the periphery of the roller 39 can be simplified by omitting the grooves I or II so that each uniting band carries only the portion 47*a* or 47*b* of the pattern shown in FIGS. 3 and 4. In other words, in its elementary form, a pattern on a uniting band may consist of a first field including a single longitudinal strip 48*a* or 48*b* which is adjacent to but spaced apart from one of two parallel edges of such uniting band, and a second field including two transverse strips (44*a'* or 44*b'*) and one of the further strips 48*c'*, 48*d'*. In each instance, each edge of the uniting band is immediately or closely adjacent to adhesive, and each uniting band has at least one uncoated portion 46*a* or 46*b* which is preferably fully surrounded by adhesive strips. It will be noted that the cutters or the knife 22 do not cut across the relatively thick longitudinal strips 48*e*, 48*f* but rather through fields including the thinner transverse strips 44*a'*, 44*b'*. This is due to the presence of clearances (see the parts 41*g*, 41*h* in FIG. 2) between the neighboring ends of the files of strips 48*e* and 48*f*. Such clearances are also coated by adhesive; however, the thickness of adhesive coats therein is less than that of the strips 48*e*, 48*f* and preferably matches the thickness of transverse strips 44*a*, 44*b*.

When a uniting band 47 is converted into a tube, the edges 47D, 47E form a seam which extends in parallelism with the axis of the respective group 51. This is due to the fact that the uniting band portion carrying that transverse strip 44*a'*, 44*b'* which adheres to the group 51 prior to reaching the wrapping conveyor 23 is overlapped by the uniting band portion carrying the other transverse strip 44*a'*, 44*b'*.

An important advantage of the improved method and apparatus is that the relatively thick longitudinal strips 48*e*, 48*f* insure the formation of strong and reliable bonds between the groups 51 and the edges 47A, 47B of the convoluted uniting bands 47. Therefore, air is not likely to be drawn into the column of tobacco smoke except when the wrappers of filter plugs of the cigarettes are provided with intentionally formed perforations or holes for admission of a predetermined quantity of cool atmospheric air into the tobacco smoke. Furthermore, the knife 27*a* is not contaminated by adhesive and the adhesive does not seep beyond the edges 47A, 47B of a convoluted uniting band. The adhesive is not likely to be squeezed out beyond the edges 47D, 47E because the fields of adhesive including the severed transverse strips 44*a'*, 44*b'* are relatively thin. It will be recalled that the end portions of of relatively thick longitudinal strips 48*e*, 48*f* terminate short of the edges 47D and 47E.

If the machine of FIG. 1 is to be converted for the manufacture of a different type of rod-shaped smokers' products, i.e., when the uniting bands 47 are to be replaced with uniting bands having other dimensions, the roll 14 is replaced with a roll of greater or lesser width and the roller 39 is replaced with a different roller. If necessary, the driven advancing roll 16 is also replaced with a different roll having a larger or smaller diameter. The pattern of grooves at the periphery of the freshly inserted roller replacing the roller 39 then conforms to the desired pattern of adhesive strips on the freshly inserted web.

The width and the spacing of transverse grooves 42*a*, 42*b* in the periphery of the roller 39 are changed when the ratio of the speed of the web to the peripheral speed of the rollers 39, 43 changes. The width and the spacing are reduced when the aforementioned ratio increases and vice versa.

It is also possible to drive the rollers 39, 43 at a peripheral speed which exceeds the speed of lengthwise movement of the web; the width of the grooves 42*a*, 42*b* and their spacing is then greater than when the speed of the web is higher.

It is further clear that the grooves can be machined into the peripheral surface of the roller 43 or into the peripheral surfaces of rollers 39 and 43.

The aforediscussed perforations for admission of cool atmospheric air into the column of tobacco smoke are provided in the uncoated portion 46*a*, 46*b* of the uniting bands 47 so that they are not affected by the application of adhesive which forms the strips along the edges of the uniting bands. Furthermore, and as explained hereinabove, the material of the uniting bands can be sufficiently porous to allow for admission of requisite quantities of atmospheric air, i.e., the making of perforations or holes in the uncoated portions 46a, 47a can be dispensed with.

The improved method can be practiced and the improved apparatus can be utilized with equal advantage in connection with the manufacture of filter tipped cigarettes, cigars or cigarillos wherein the converted uniting bands (tubes) are not porous at all (i.e., wherein the webs which are converted into uniting bands exhibit negligible permeability and are not formed with artificial holes or perforations for admission of atmospheric air) or wherein the permeability of webs is attributable solely to porosity of their material. Even though the making of relatively thick longitudinal strips entails a greater consumption of adhesive, this is more than compensated for by the fact that the adhesive need not coat an entire side of the web even though the web can be subdivided into uniting bands which establish highly satisfactory leakproof bonds between filter plugs and plain cigarettes, cigars or cigarillos. The areas of uncoated portions 46a and 46b are so large that, by resorting to the method and apparatus of the present invention, one can achieve substantial savings in adhesive in spite of the fact that the thickness of longitudinal strips exceeds the average thickness of adhesive coats. The savings in adhesive for a single cigarette are minimal; however, the savings in a filter tipping or like machine during a longer period of time (e.g., a month, six months or one year) are surprisingly high because a filter tipping machine can turn out millions of filter cigarettes or like smokers' products per day.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of treating a web of wrapping material in a machine for the processing of rod-shaped smokers' products, comprising the steps of transporting the web lengthwise along a predetermined path; coating one side of the moving web, including applying to said one side a recurrent pattern of adhesive which comprises first fields including discrete longitudinal strips adjacent to but slightly spaced apart from at least one marginal portion of the web and having a first thickness and second fields including portions disposed between said strips and having a second thickness less than said first thickness; and repeatedly severing the leader of the moving web across said portions of successive second fields so that said web yields a series of discrete uniting bands each having two first parallel edges one of which is adjacent to the respective longitudinal strip and two second parallel edges adjacent to the end portions of the respective longitudinal strip.

2. The method of claim 1, wherein said coating step further includes applying to said one side of the moving web additional strips inwardly adjacent to said longitudinal strips and having a thickness which at least approximates said second thickness.

3. The method of claim 1, wherein said coating step further comprises applying to said one side discrete longitudinal strips adjacent to but slightly spaced apart from the other marginal portion of the web so that each longitudinal strip at said one first edge is aligned with a longitudinal strip at the other of said first edges and each of said first edges of a uniting band is adjacent to but slightly spaced apart from a discrete longitudinal strip upon severing of such uniting band from the moving web.

4. The method of claim 3, wherein said coating step further includes applying to said one side a pair of further strips disposed substantially midway between the marginal portions of the web.

5. The method of claim 4, wherein said further strips have a thickness which at least approximates said second thickness.

6. The method of claim 1, wherein said second fields further includes transverse strips extending transversely of said one side of the moving web and said severing step includes severing the moving web across successive transverse patches, said second parallel edges of each uniting band being adjacent to portions of the corresponding transverse strips.

7. The method of claim 6, wherein said coating step further includes applying to said one side a pair of further strips disposed substantially midway between the marginal portions of the web, said transverse strips being applied in the form of two aligned sections one of which extends between one of said further strips and the nearer marginal portion and the other of which extends between the other of said further strips and the marginal portion nearer to said other further strip.

8. The method of claim 1, further comprising the steps of conveying a succession of groups of aligned coaxial rod-shaped articles sideways along a second path, and attaching successive uniting bands to successive groups in said second path so that said longitudinal strips extend transversely of the common axis of articles in the respective group.

9. The method of claim 8, further comprising the step of convoluting said uniting bands around the articles of the respective groups.

10. The method of claim 1, wherein said longitudinal strips terminate short of both second edges of the respective uniting bands.

11. Apparatus for treating a web of wrapping material in a machine for the processing of rod-shaped smokers' products, comprising means for transporting the web lengthwise along a predetermined path; a paster adjacent to said path and including a source of adhesive and means for applying to one side of the moving web a recurrent pattern of adhesive including a first field having discrete longitudinal strips adjacent to at least one marginal portion of the moving web but slightly spaced apart from said one marginal portion and having a first thickness, and a second field including portions disposed between said longitudinal strips and having a second thickness less than said first thickness; and means for severing the leader of the moving web across said portions of successive second fields so that said web yields a succession of uniting bands each having two first parallel edges one of which is adjacent to the respective longitudinal strip and two second parallel edges adjacent to the end portions of the respective longitudinal strip.

12. The apparatus of claim 11, wherein said applying means comprises a roller rotatable about an axis which extends transversely of said path and including a peripheral surface having at least one circumferentially extending groove having portions of a first depth for reception of said longitudinal strips.

13. The apparatus of claim 12, wherein said peripheral surface of said roller dips into said supply of adhesive.

14. The apparatus of claim 13, further comprising a second roller having a second peripheral surface receiving adhesive from said grooves and contacting said one side of the moving web.

15. The apparatus of claim 12, wherein said peripheral surface has at least one second circumferentially extending groove of said first depth, said circumferentially extending grooves being parallel to and spaced apart from each other, as considered in the axial direction of said roller.

16. The apparatus of claim 15, wherein said peripheral surface has two further circumferentially extending grooves located midway between said grooves of said first depth and having a depth which is less than said first depth.

17. The apparatus of claim 16, wherein said further grooves and said grooves of said first depth are mirror symmetrical to each other with reference to a plane normal to the axis of said roller and disposed between said further grooves.

18. The apparatus of claim 12, further comprising means for rotating said roller at a peripheral speed which deviates from the speed of lengthwise movement of the web.

19. The apparatus of claim 11, further comprising means for conveying a series of groups of coaxial rod-shaped articles sideways along a second path and means for attaching successive uniting bands to successive groups so that said longitudinal strips extend transversely of the axes of articles in the respective groups.

20. The apparatus of claim 19, further comprising means for convoluting said uniting bands around the articles of the respective groups.

21. The apparatus of claim 11, wherein said second fields further include transverse strips extending transversely of said one side of the web between said longitudinal strips, said severing means being arranged to sever the leader of the moving web across successive transverse strips so that each of said second edges of a uniting band is adjacent to a portion of a severed transverse strip.

22. The apparatus of claim 21, wherein said second fields further include additional strips inwardly adjacent to said longitudinal strips.

23. The apparatus of claim 22, wherein said second fields include further strips parallel to said longitudinal strips, said additional strips being disposed between said longitudinal strips and said further strips.

* * * * *